United States Patent [19]

Komatsu

[11] Patent Number: 5,042,349

[45] Date of Patent: Aug. 27, 1991

[54] CUTTER

[75] Inventor: Fumito Komatsu, Suwa, Japan

[73] Assignee: Sankyo Seiki Mfg. Co., Ltd., Nagano, Japan

[21] Appl. No.: 497,088

[22] Filed: Mar. 21, 1990

[30] Foreign Application Priority Data

Mar. 24, 1989 [JP] Japan ..... 1-73494

[51] Int. Cl.[5] ..... B26D 1/24

[52] U.S. Cl. ..... 83/501; 83/485; 83/488

[58] Field of Search ..... 83/501, 500, 499, 502, 83/503, 498, 504, 676, 664, 665, 485, 488, 489

[56] References Cited

U.S. PATENT DOCUMENTS

| | | | |
|---|---|---|---|
| 3,645,158 | 2/1972 | Greis | 83/492 |
| 4,028,973 | 6/1977 | Bogdanski et al. | 83/169 |
| 4,691,605 | 9/1987 | Vanetik et al. | 83/175 |
| 4,784,030 | 11/1988 | Waring | 83/105 |

FOREIGN PATENT DOCUMENTS

| | | | |
|---|---|---|---|
| 629304 | 12/1961 | Italy | 83/500 |
| 2072563 | 10/1981 | United Kingdom | 83/498 |

*Primary Examiner*—Frank T. Yost
*Assistant Examiner*—John M. Husar
*Attorney, Agent, or Firm*—McAulay Fisher Nissen Goldberg & Kiel

[57] ABSTRACT

A cutter for cutting sheets of material, paper and the like comprises a cup-type main rotary blade and a sub-rotary blade. The main rotary blade is supported by a main rotary shaft and has an edge part for performing cutting. The sub-rotary blade is rotationally responsive to rotational movement of the main rotary blade, has an edge part for performing cutting and is rotatably disposed to face the main rotary blade. A holding mechanism rotatably holds the main and sub-rotary blades so that the respective edge parts face each other in an overlapping manner. The holding mechanism is motor driven to enable the mechanism to move toward or away from the cutting work. A wire and pulley arrangement coupled to the holding mechanism functions to cause the main rotary blade to rotate as the holding mechanism is caused to move. A coil spring or a pair of plate springs bring the edge parts of the main and sub-rotary blades into press contact. This results in a cutting element having constantly varying cutting surfaces during cutting action.

5 Claims, 5 Drawing Sheets

CUTTER

FIELD OF THE PRESENT INVENTION

The present relates to a cutter to be used to cut paper, cloth and other sheets.

BACKGROUND OF THE PRESENT INVENTION

In the nature of background for practical application of the present invention, reference is made to the system shown in FIG. 6. That Figure shows a recorder with a cutter for cutting roll paper. Therein symbol "1" denotes a key part of a single-pass type color plotter of an electrostatic recording - wet type developing system. The electrostatic recording roll paper 2, which is wound around a winding core 2*a*, is rotatably supported on a roll paper supporter 3. It has a width of 914 mm according to Japanese Industrial Standard AO, for example, and is rotatably supported on a support member not illustrated herein.

The roll paper 2 is drawn from the winding core 2*a* and is transferred to an upper cover unit 5 by a feeder. A roll paper path between the roll paper 2 and feeder 4 is provided with a cutter 6, a black recorder 7B, a cyan recorder 7C, a magenta recorder 7M and a yellow recorder 7Y in that order. The black recorder 7B is made from multi-needle electrode rows and consists of a recording head 7*a* for prescribed dot-shaped charge of roll paper, a pad 7*b* for giving a prescribed pressure for pressing the roll paper against the head 7*a*, a developing container 7*c* for storing developers including black toner for blackening, a developing roller 7*d* for feeding developers to the recording side of the roll paper and a cleaner 7*f* for removing the excess developers attaching to the non-recording part of the development-completed roll paper. The construction of cyan recorder 7C, magenta recorder 7M and yellow recorder 7Y differ from that of the black recorder 7B only in that the former store a developer containing a blue-coloring cyan toner, a developer containing a red-coloring magenta toner and a developer containing a yellow-coloring yellow toner.

The feeder 4 consists of a feeding roller body 4*a* around which roll paper can be wound, driving means (not illustrated) for driving the roller in the paper feed direction indicated by the arrow (a), and a pinch roller 4*b* for pressing the roll paper against the feeding roller body. The roller body 4*a* is supported rotatably on the upper cover unit 5 and the pinch roller 4*b* is received by the front cover 4*d* and is supported on the plotter body by a shaft 4*c* so as to be capable of swinging.

When the recording signal based on recording information is supplied from a controller (not illustrated herein) to the recording heads 7*a* of the recorders, they electrically charge the roll paper 2 in accordance with the color signal to form a dot-type electrostatic latent image. The latent image is brought to visualization by the toners of varied colors when the roll paper, which is fed while the feeding roller body 4*a* is running, enters the developing roller 7*d*. That is, roll paper 2 forms a colored picture after passing the recorders once. When recording pictures are formed on a part with a prescribed length of the roll paper, it is cut at prescribed points by a cutter 6.

As published in the gazette of Japanese Utility Model No. 7079/1978, etc., some cutters consist of a fixed blade whose length is a little longer than the cutting length of the work to be cut and of a movable blade having substantially the same length as the fixed blade and rotating in press contact therewith to cut roll paper. Also known are cutters whose rotary blade is run while being rotated in contact with the fixed blade.

The first of the above-mentioned cutters requires troublesome setting of the cutting work (e.g. roll paper) since it is necessary, between the fixed and movable blades and the structure, to maintain rigidity of the fixed and movable blades. This becomes complicated and bulky since increase in length of the blades naturally results.

This first prior art reference, though facilitating setting of cutting work, requires a long fixed blade which requires being given a structure for securing its rigidity when the cutting length is large and a steady decrease in its cutting property occurs since the fixed blade wears more rapidly than the rotary blade.

An object of the invention, therefore, is to provide a cutter which facilitates setting of the cutting work, maintains a cutting property over a long period and has a simple structure for securing its rigidity in cutting large-length cutting work.

In accordance with the invention, a cutter for cutting sheet material such as paper comprises a first driving cup-like rotary blade having a first circular cutting edge and a second driven cup-like rotary blade having a second circular cutting edge. The first and second cutting edges overlap over a predetermined arc and are in operative engagement with one another. First driving means are coupled to the first rotary blade to cause rotational movement of the first rotary blade. Means are included to bias the first and second cutting edges toward each other to engage and cut sheet material between the cutting edges and to cause the driven blade to rotate in response to rotation of the driving blade. The cutting points of the first and second blades continuously vary as the blades rotate so that the entire cutting edge of each the blades performs a cutting function during rotation of the blades.

Also in accordance with the invention, a cutter for cutting sheets of material, paper and the like comprises a cup-type main rotary blade supported by a main rotary shaft and having an edge part for performing cutting, driving means coupled to the main rotary shaft for rotating the rotary shaft in the work cutting direction and a cup-type sub-rotary blade, which is rotationally responsive to rotational movement of the main rotary blade, having an edge part for performing cutting and being rotatably disposed to face the main rotary blade. Also included are holding means for rotatably holding the main and sub-rotary blades so that the respective edge parts face each other in an overlapping manner and press-contacting means for bringing the edge parts of the main and sub-rotary blades into press contact to form a cutting element having constantly varying cutting portions during cutting action.

The invention will more fully be understood by reference to the following description taken in conjunction with the accompanying drawings. The scope of the invention will be pointed out in the appended claims.

Figure 1:
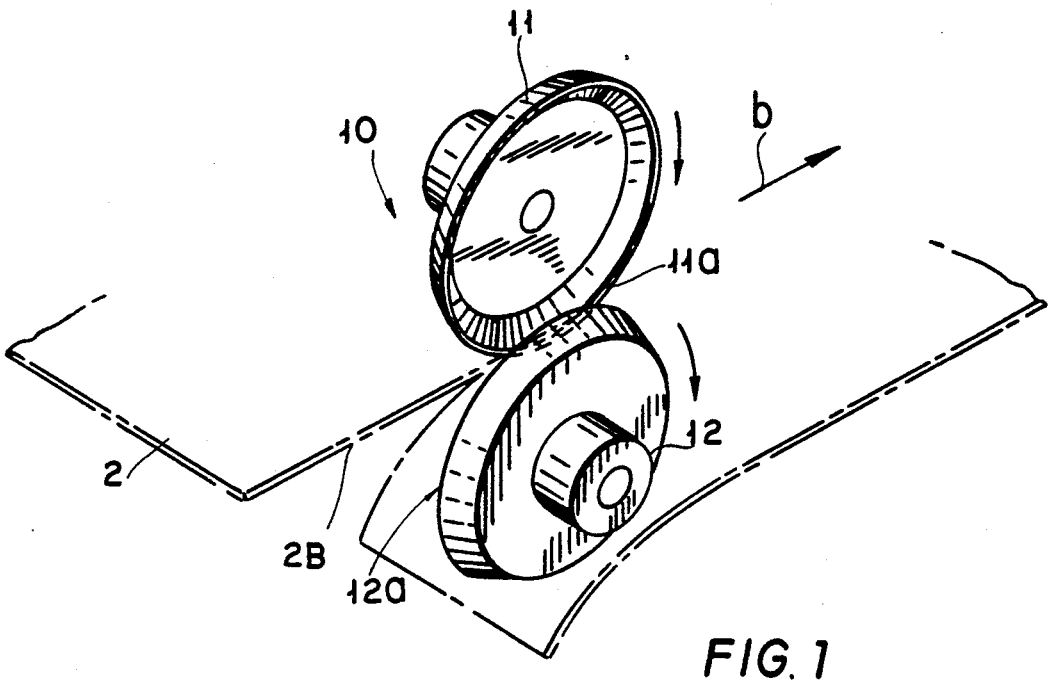
FIG. 1 is perspective view illustrating the principle of the present invention.

DESCRIPTION OF THE PREFERRED EMBODIMENTS:

FIG. 1 illustrates the principle of the present invention. The main components of the cutter 10 are a shallow cup type main rotary blade 11 whose edge part 11*a* is used as a cutting blade and a cup type sub-rotary blade 12 which is disposed in press contact with the main rotary blade. These are the common parts. The sub-rotary blade 12 uses its edge part 12*a* as a cutting blade and follows the main rotary blade 11 in rotation. When the main rotary blade 11 is moved in the arrow-(b) direction together with the sub-rotary blade 12 while being driven in the rotational direction of the clockwise arrow, the facing parts of both blades cut the cutting work roll paper at a cutting line 2B.

The first embodiment of the invention will be described in conjunction with FIGS. 2 and 3. A main rotary blade 11 is inserted at one end 13*a* of the main rotary shaft !3 and is fastened by a screw 14. A main rotary shaft 13 is passed rotatably through a bearing sleeve 15. The end face at the flange part 15*a* of the sleeve 15 is brought into contact with the bottom face of the main rotary blade 12. The one end part 16*a* of a plate spring member 16 serving as holding member and press contacting means also is sandwiched between a flange part 15*a* and a spacer 17 and is fitted to the sleeve 15. An arm 18*a*, which is formed to suspend from a slider 18, is fastened by a fastening nut 20 screwed to the threaded part of the sleeve with a spring washer disposed therebetween. A driving pulley 21 is fitted and fastened by a screw at the other end 13*b* of the main rotary shaft 13. The slider 18 and plate spring member 16 are combined with each other with the sleeve 15 disposed therebetween and the main rotary blade 11 and driving pulley 2 are combined with each other with the main rotary shaft 13 disposed therebetween.

The sub-rotary blade 12 is inserted and fastened by a screw 24 at one end 23*a* of the sub-rotary shaft 23. A bearing sleeve with a flange 25*a* and a thread 25*b* is passed through the sub-rotary shaft 23. The suspending end part 16*c* of the plate spring member 16 is fitted into the sleeve 25 and combined therewith by a spacer 42, a spring washer 26 and a nut 27. As illustrated in FIG. 2, the bent part 16*b* of the plate spring member 16 is passed through a clearance 30 formed between the facing parts A and B at the edge parts 11*a*, 12*a* of both rotary blades 11 and 12. The plate spring member 16 is given an elasticity which is directed so that the edge part 12*a* of the sub-rotary blade 12 comes into contact with 11*a* of the main rotary blade 11 for providing a function of bringing the edge parts of the both rotary blades into press contact. As shown in FIG. 2, the plate spring member 16 is also provided with a function for maintaining the distance between both rotary blades together with the clearance 30 held in common by the arc portions of the both rotary blades. The edge parts, serving as at least cutting blades of the main rotary blade 11 and sub-rotary blade 12, are preferably composed of metal which is quenched. A stationary wire 31 is wound round the driving pulley. The rotary blades may be made from ceramic.

Figure 5:
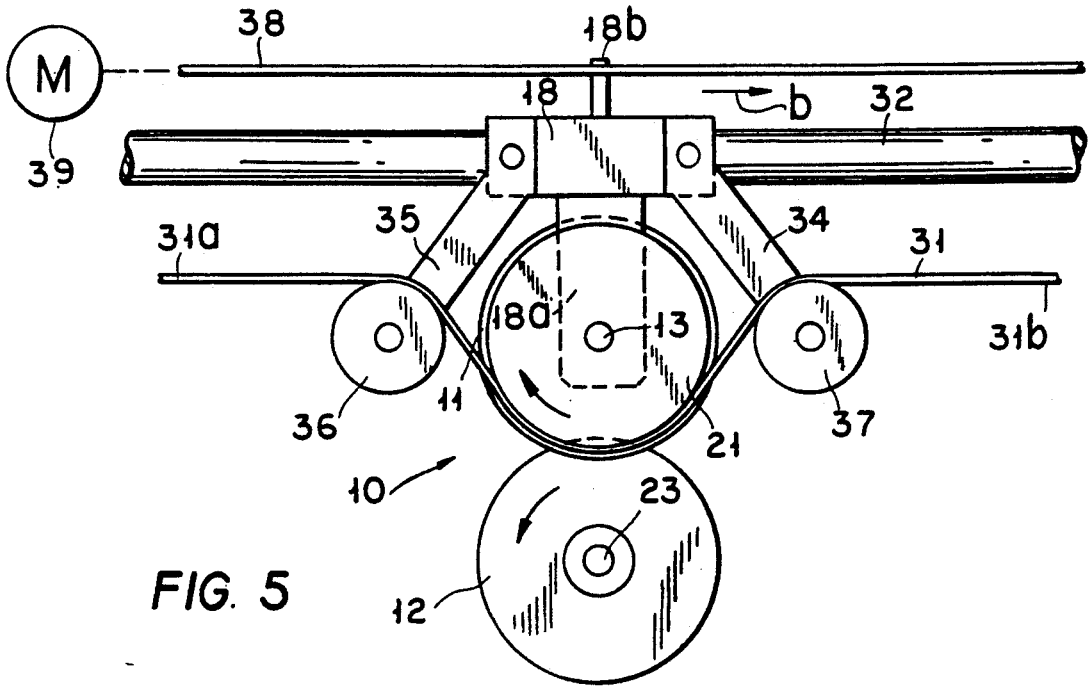
FIG. 5 is a front view of a driving means.
Figure 3:
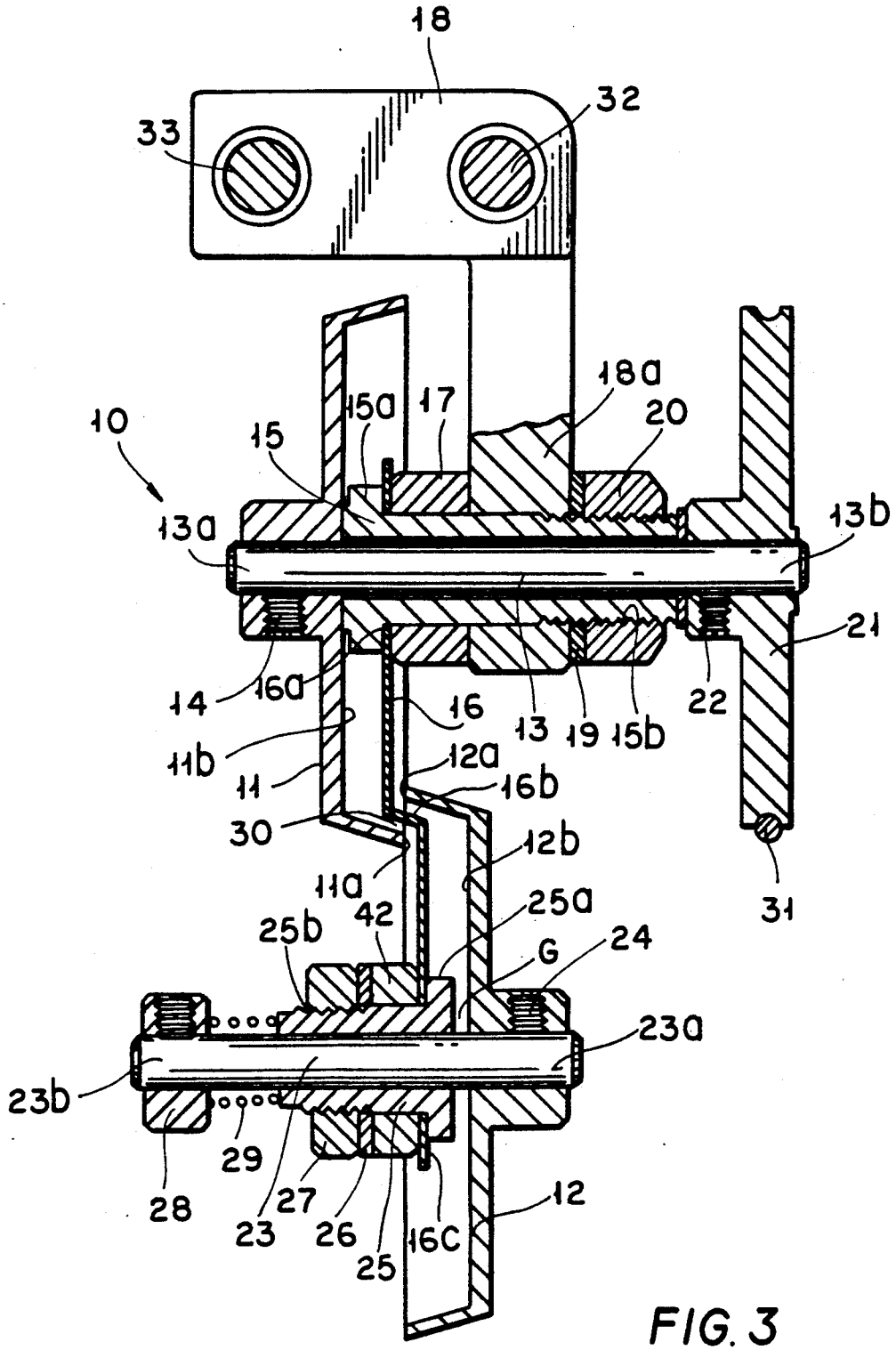
FIG. 3 is a side sectional view of the above.
Figure 6:
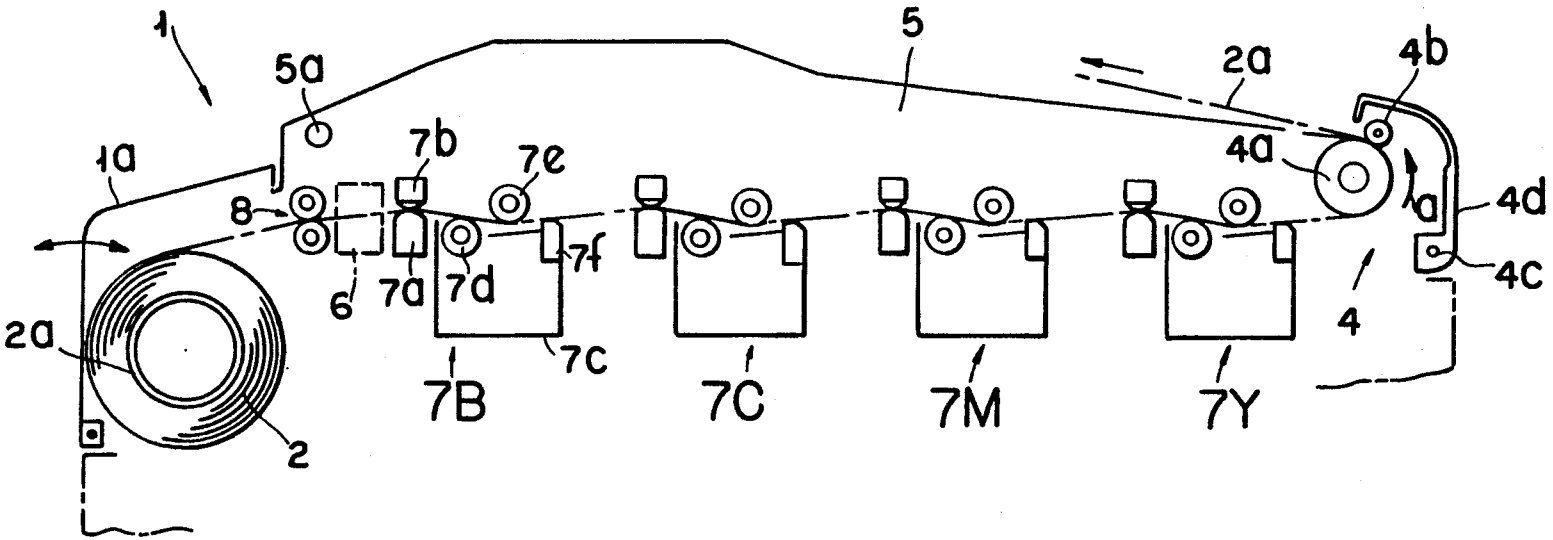
FIG. 6 is a schematic side view of a color plotter as an example of equipment which requires a cutter.

As shown in FIGS. 3 and 5, the slider 18 is slidably supported on the guides 32, 33 and is set orthogonally with the carriage direction of roll paper. The guide shafts 32, 33 are provided on the upper cover unit 5 as shown in FIG. 6. Provided that the structure in FIG. 5 is inverted, it may also be disposed on the plotter body side. Brackets 34, 35 are fastened before and after in the axial direction of a guide shaft and guide pulleys 36, 37 are rotatably supported at their lower end parts. The guide pulleys 36, 37 are located so that the winding angle of a stationary wire 31 around the driving pulley 21 becomes large. The stationary wire 31 is tautly connected by both end parts to an unmovable member not illustrated herein. A driving wire 38 is stretched in parallel to guide shafts 32,33. Part of the wire 38 is connected to the clamp pin of the slider and is wound around a pair of pulleys which also are not illustrated herein. Either of the pulleys is connected to a driving motor 39 which is controlled to run positively and negatively. When the driving motor 39 is caused to run positively, for example, the wire 31 is pulled in one direction to move the slider 18 in the arrow-(b) direction. When the slider 18 travels, the driving pulley 21, around which the stationary wire 31 is wound, is rotated in the direction of the arrow to drive the main rotary blade 11 in the same direction so that the sub-rotary blade 12, which is in press contact therewith, runs in the direction of the arrow. When both rotary blades run, the mutually sliding contacting portions of the edge parts, which are in press contact, constantly vary so that the edge portions 12*a*, 12*b* are free from one-sided wear. In the case of the illustrated example, a driving means for driving the main rotary blade 11 consists of a driving motor 39, a wire 38, pulleys 21, 36 and 37 and a stationary wire 31. Alternatively, the driving pulley 21 may be replaced with a pinion and the stationary wire 31 with a rack. Further, it is permitted to employ a motor as means for the direct drive of the main rotary shaft 13. On roll paper setting and during non-cutting operation, the cutter 10 is set in the standby position away from the paper path.

Figure 2:
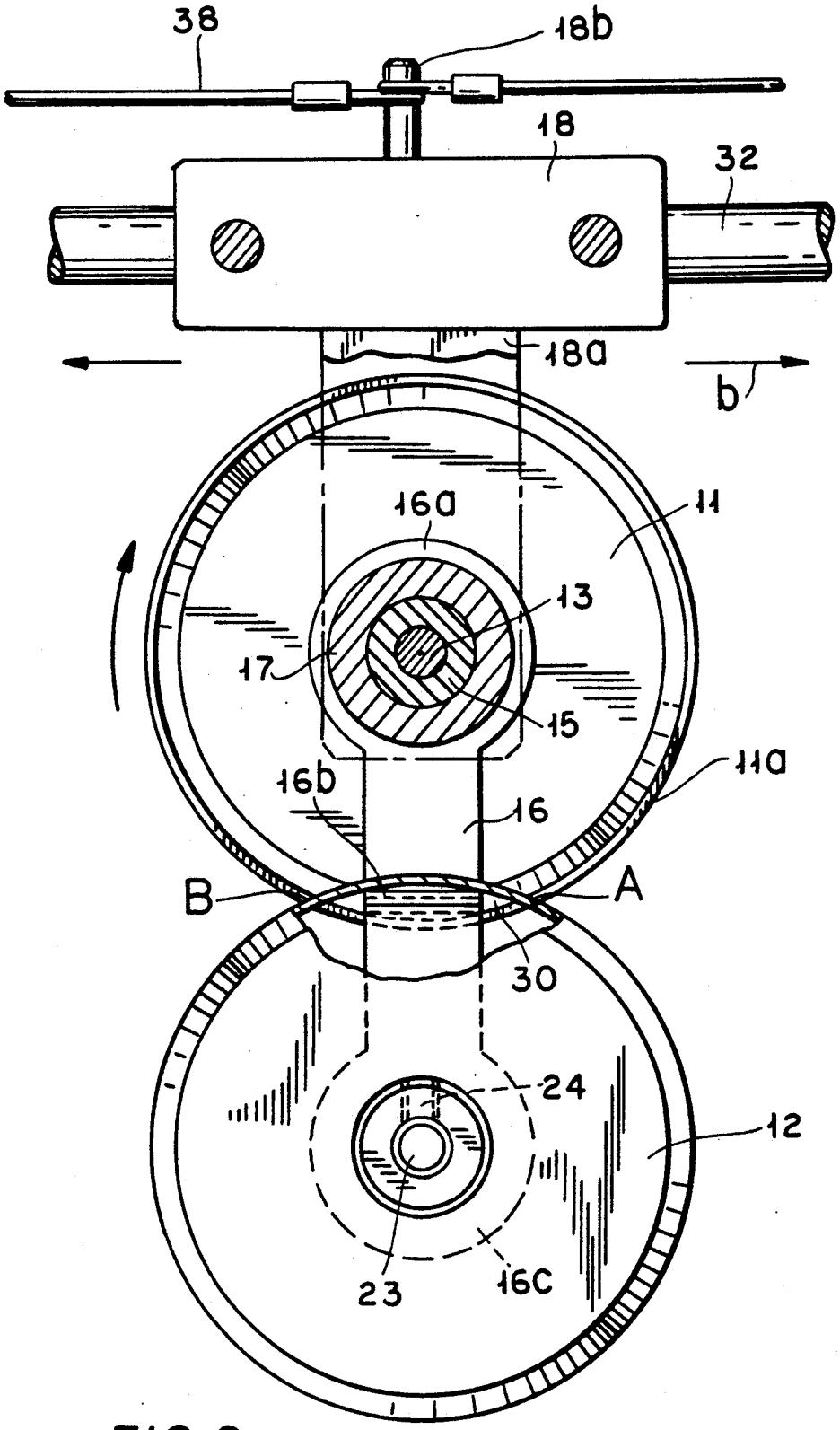
FIG. 2 is a partial sectional front view of an embodiment of the invention.

Cutting work roll sheet 2 is cut at a cutting line 2B as shown in FIG. 1 by the mutually press-contacting facing parts when the main rotary blade 11 and sub-rotary blade 12 are rotated with the slider 18 traveling in the arrow-(b) direction as shown in FIG. 2. The facing parts B of both rotary blades cut the roll paper when the slider 18 is moved opposite to the arrow-(b) as shown in FIG. 2. Cutting may, of course, be performed only when the slider 18 is moved in one direction.

Figure 4:
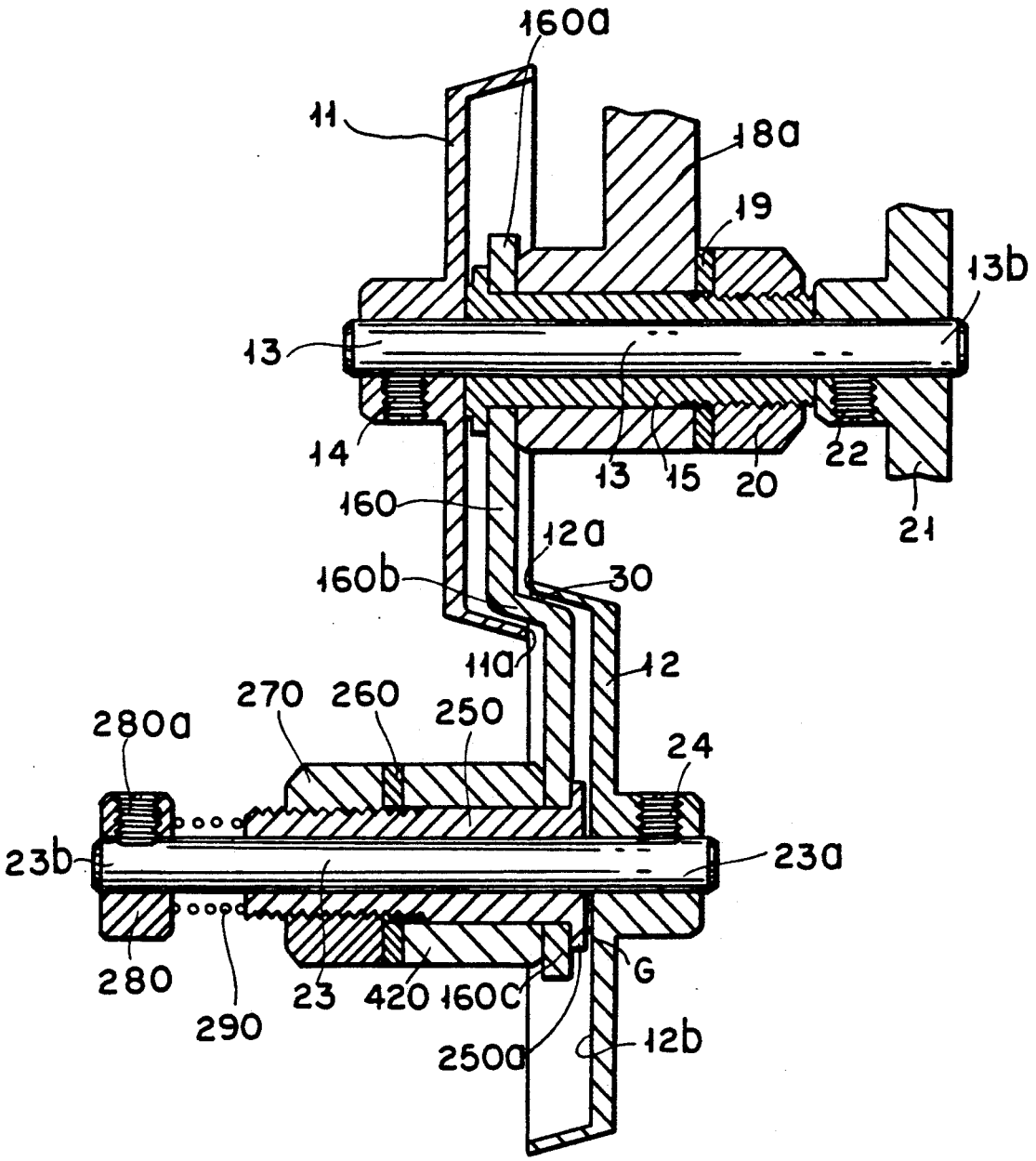
FIG. 4 is a side sectional view of only the key part of another embodiment of the invention.

Next, the second embodiment of the invention will be described in conjunction with FIG. 4. The means for holding and press-contacting both rotary blades of this embodiment and those of the first embodiment are made from different kinds of members. The structures differ in that the base part 160*a* of a rigid holding member 160 is fitted and fastened to the bearing sleeve 13. The bent part 160*b* of the holding member is suspended through the clearance 30 formed by both rotary blades to support the bearing sleeve 250 at its lower end part 160*c*. The lower part 160*c* is fastened by the flange 250*a* of the sleeve 250, a spacer 420, a washer 260 and a nut 270. The sub-rotary shaft 23 is inserted into the sleeve 250 and supported rotatably thereby and a spring seat 280 is fastened at its other end part 23*b* by a screw 280*b*. A coil spring 290, serving as press-contacting means, is elastically fitted on the shaft between the spring seat and the end face of the sleeve to bring edge part 12*a* of the sub-rotary blade 12 and edge part 11*a* of the main rotary blade 11 into press contact. A gap G is, of course, formed between its flange part 250*a* and bottom part 12*b*.

The first embodiment requires only a small quantity of parts to advantage, providing a plate spring member 16 having both functions of holding and press-contacting members. It permits decrease in the size of the clearance 30 formed by the both rotary blades for the passage of the plate spring member so as to cause a decrease of the angle between the tangents of both rotary blades at the facing part A and a decrease of the angle of cutting into the cutting work so that it is capable of securely cutting even relatively thin papers, low-rigidity cloths, etc. The second embodiment has both rotary blades held by rigid holding members. The rotary blades are brought into press contact by applying a large press-contacting force so that it is capable of cutting even relatively thick cutting work.

In this embodiment the cutter device moves longitudinally while the main and sub-rotary blades rotate when cutting a fixed cutting work. On the other hand, the arrangement of this invention permits movement of the cutting work with the position of both rotary blades being fixed. In this case, it is capable of cutting when the cutting work is moved along the straight and curved cutting lines drawn along a facing part (e.g. A) with both rotary blades being rotated through the drive of the main driving shaft by a motor.

The illustrated embodiment has both rotary blade holding means passed through a clearance 30 so that the cutter is capable of cutting in both travel directions. For cutting by moving the both rotary blades in only one direction, it is not necessary to pass the holding members through the clearance 30 and their location should be made at a lower flow spot than the one traveling in relation with cutting work of the facing parts A, B of both rotary blades.

As described above, the rotary cutter according to the invention is free from one-sided wear of the cutting blades and a steady decrease in their cutting property since the main and sub-rotary blades, which are rotating in press contact with each other, are moved in relation with the cutting work. Furthermore, it facilitates the setting of such cutting work, such as being stretched like roll paper, for example, since their setting is permitted in a standby position away from the traveling path of the cutting work when no cutting is performed.

While the foregoing description and drawings represent the preferred embodiments of the present invention, it will be obvious to those skilled in the art that various changes and modifications may be made therein without departing from the true spirit and scope of the present invention.

What is claimed is:

1. A cutter for cutting sheets of material, paper and the like comprising:

a cup-type main rotary blade supported by a main rotary shaft and having an edge part for performing cutting;

driving means coupled to said main rotary shaft for rotating said main rotary selectively in a forward or reverse cutting direction;

a cup-type sub-rotary blade, rotationally responsive to rotational movement of said main rotary blade, having an edge part for performing cutting and being rotatably disposed to face said main rotary blade;

holding means for rotatably holding said main and sub-rotary blades so that said respective edge parts face each other in an overlapping manner to provide a cutting edge for either direction of movement of said blades; and press-contacting means for bringing the edge parts of said main and sub-rotary blades into press contact to form a cutting element having constantly varying cutting portions during cutting action.

2. The cutter of claim 1 wherein said press contacting means includes a first spring plate element mounted on a support for said main rotary blade and a second spring plate element mounted on a support for said sub-rotary blade, said spring elements being in mechanical contact to provide said 6 press contact.

3. The cutter of claim 1 wherein said holding means is slidably mounted on a guide and wherein said driving means for said holding means includes a motor having a movable wire being driven by said motor and being affixed to said holding means.

4. The cutter of claim 3 also including a stationary wire wound about a pulley mounted on said main rotary shaft, said wire being in mechanical contact with said holding means so that movement of said holding means toward or away from the cutting work results in rotation of said main rotary blade and consequent rotation of said sub-rotary blade.

5. The cutter of claim 1 including a rigid holding member mounted on support elements of said main rotary blade and said sub-rotary blade and wherein a coil spring is disposed on a shaft of said sub-rotary blade for bringing said main and sub-rotary blades into press contact.

* * * * *